US005628153A

United States Patent [19]

Fontanez

[11] Patent Number: 5,628,153

[45] Date of Patent: May 13, 1997

[54] STORAGE BIN SYSTEM

[76] Inventor: Donna V. Fontanez, 1754 Heckscher Ave., Bay Shore, N.Y. 11706-2121

[21] Appl. No.: 450,865

[22] Filed: May 26, 1995

[51] Int. Cl.[6] ..... G09F 7/18

[52] U.S. Cl. ..... 52/39; 52/29; 312/246

[58] Field of Search ..... 52/29, 39; 248/317, 248/343; 312/242, 246, 247, 245

[56] References Cited

U.S. PATENT DOCUMENTS 4,446,660 5/1984 Miller et al. ..... 52/39 X 4,699,437 10/1987 Genereaux ..... 312/246 X 5,239,790 8/1993 Fetzer ..... 312/245 X

*Primary Examiner*—Creighton Smith

*Attorney, Agent, or Firm*—Michael I. Kroll

[57] ABSTRACT

An improved storage bin system comprising a plurality of spaced apart parallel pieces of timber used in construction of a building. A plurality of storing receptacles are provided. A structure is for mounting each of the storing receptacles between two of the adjacent pieces of timber. The storing receptacles can hold articles therein, instead of on a floor in a building.

5 Claims, 3 Drawing Sheets

STORAGE BIN SYSTEM

BACKGROUND OF THE INVENTION

1. Field of the Invention

The instant invention relates generally to storing containers and more specifically it relates to an improved storage bin system.

2. Description of the Prior Art

Numerous storing containers have been provided in prior art that are adapted to put aside various articles for future use. While these units may be suitable for the particular purpose to which they address, they would not be as suitable for the purposes of the present invention as heretofore described.

SUMMARY OF THE INVENTION

A primary object of the present invention is to provide an improved storage bin system that will overcome the shortcomings of the prior art devices.

Another object is to provide an improved storage bin system that utilizes receptacles in which each are sized to fit in a sliding manner between rafters, joists and studs, so that the receptacles will store various articles therein, thereby taking up less room in a building by saving floor space.

An additional object is to provide an improved storage bin system in which each receptacle is heat resistant, lightweight and weatherproofed to protect the articles stored therein.

A further object is to provide an improved storage bin system that is simple and easy to use.

A still further object is to provide an improved storage bin system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 3:
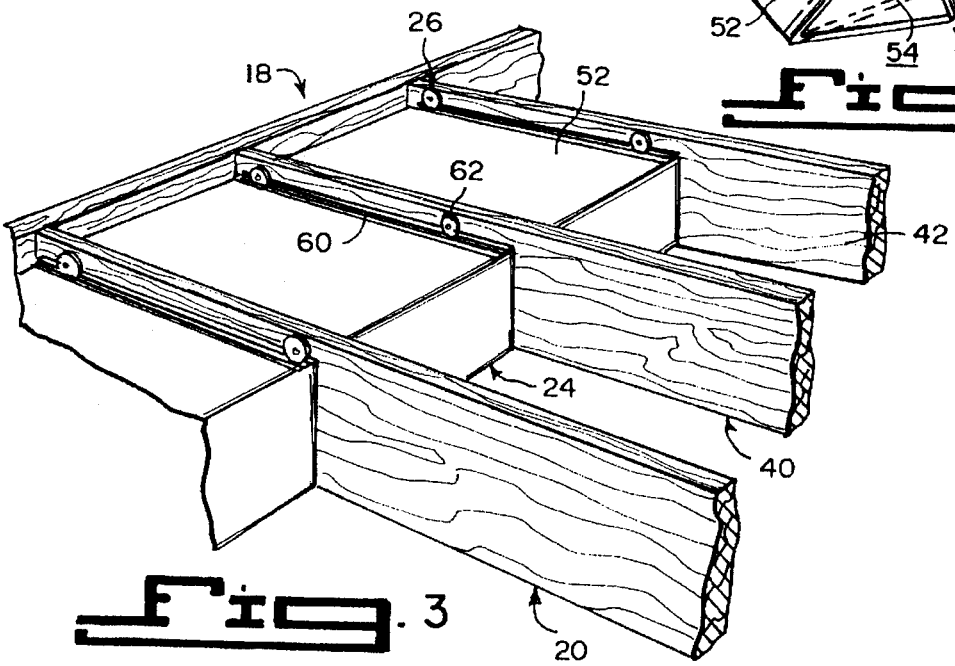

FIG. 3 a perspective view of a portion of the joists, showing the storing receptacles therebetween.

Figure 4:
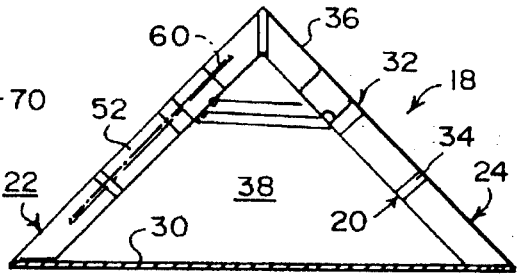

FIG. 4 is a diagrammatic elevational view of the roof, showing the way the storing receptacles are stacked between the rafters.

Figure 5:
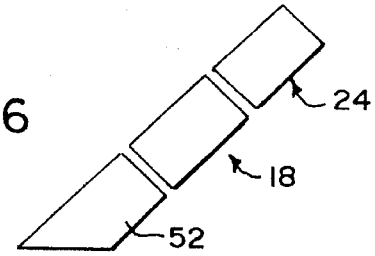

FIG. 5 is a diagrammatic elevational view, showing the stacked rafter storing receptacles.

Figure 6:
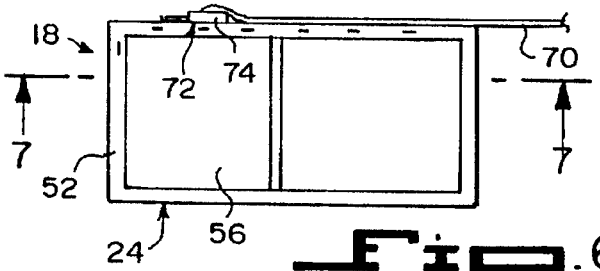

FIG. 6 is a top view of one rafter storing receptacle.

Figure 7:
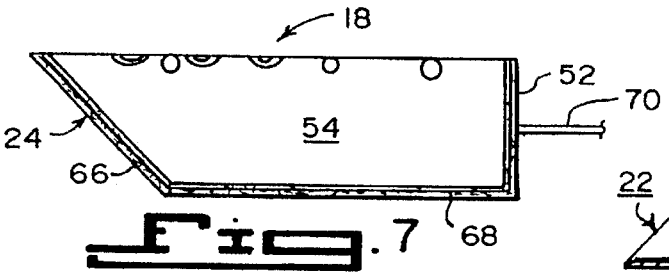

FIG. 7 a diagrammatic cross sectional view taken along line 7—7 in FIG. 6.

Figure 8:
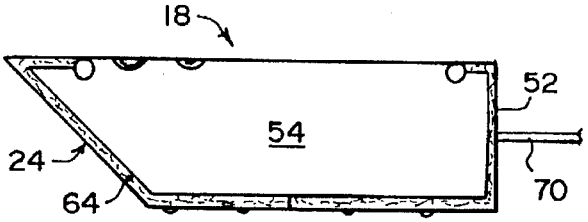

FIG. 8 is a diagrammatic cross sectional view similar to FIG. 7 of a modified rafter storing receptacle.

Figure 9:
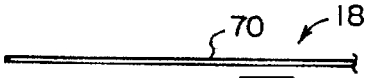

FIG. 9 is an enlarged elevational view of the tow line shown in FIG. 7.

Figure 10:
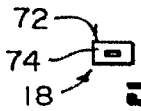

FIG. 10 is an enlarged elevational view of the staple, which retains one end of the tow line to the side of rafter storing receptacle.

Figure 11:
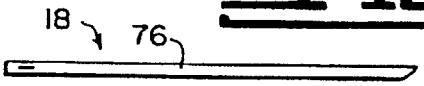

FIG. 11 is an enlarged elevational view of a needle that is used to thread the end of the tow line into the staple.

Figure 12:
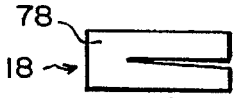

FIG. 12 is a diagrammatic elevational view of a heater that is used to secure the staple with the end of the tow line to the side of the storing receptacle.

Figure 13:
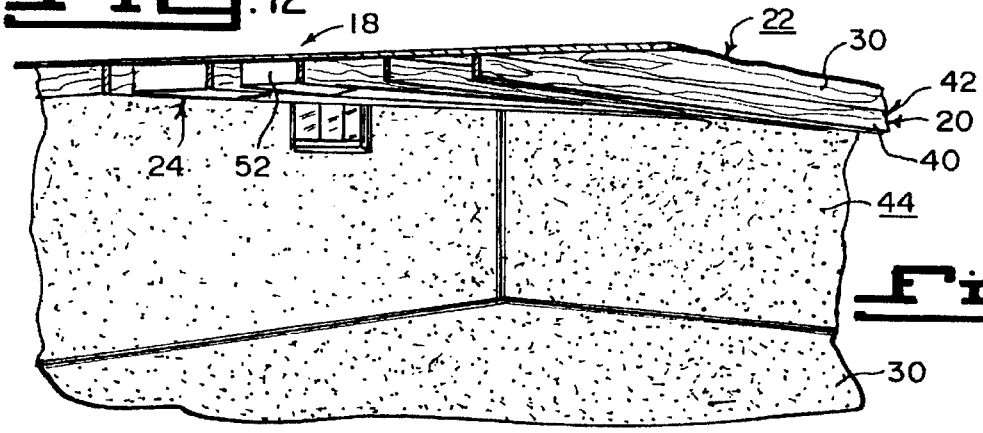

FIG. 13 is a perspective view of a portion of a basement of a building, showing storing receptacles between the joists.

Figure 14:
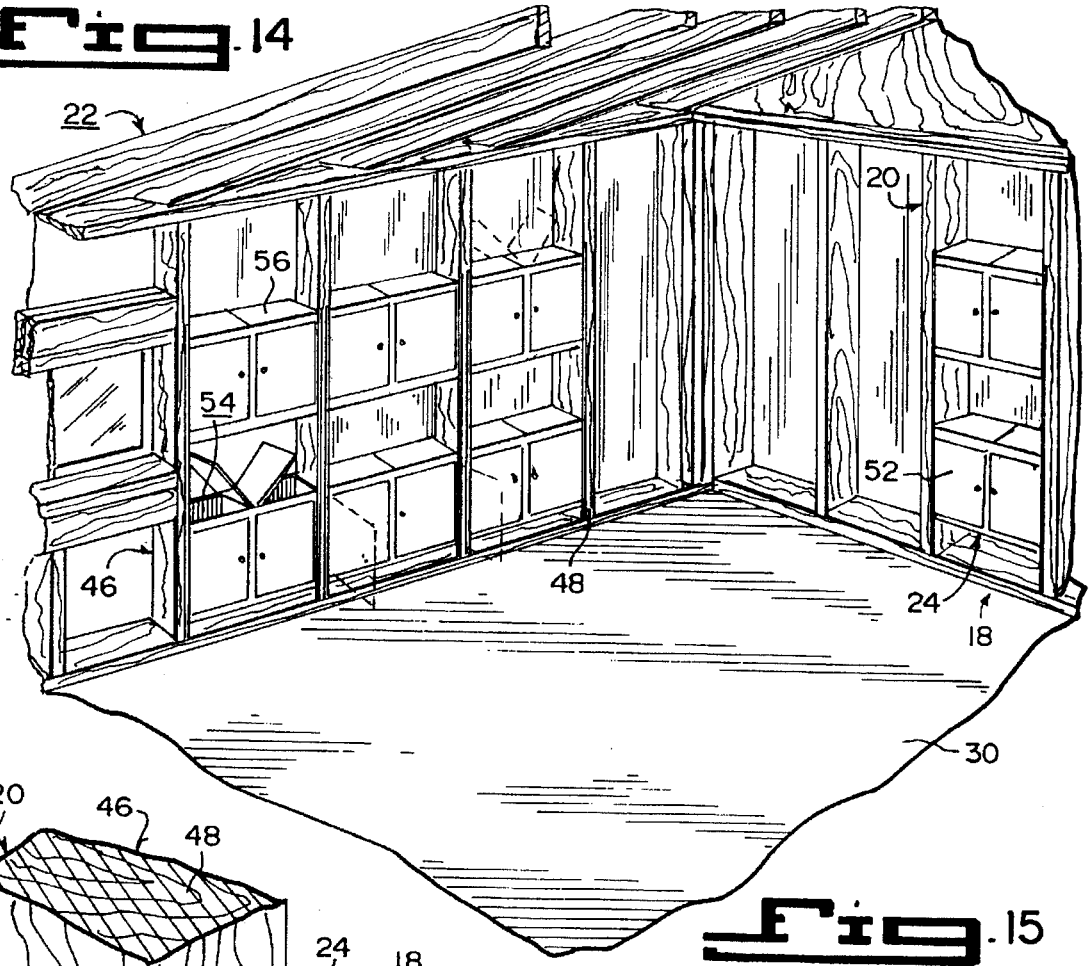

FIG. 14 is a perspective view of a portion of a garage, showing storing receptacles between the studs.

Figure 15:
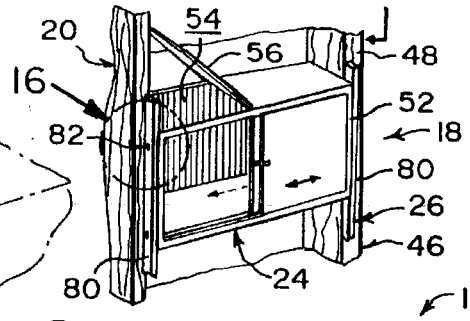

FIG. 15 is a perspective view, showing how one of the storing receptacles is retained between two studs.

Figure 16:
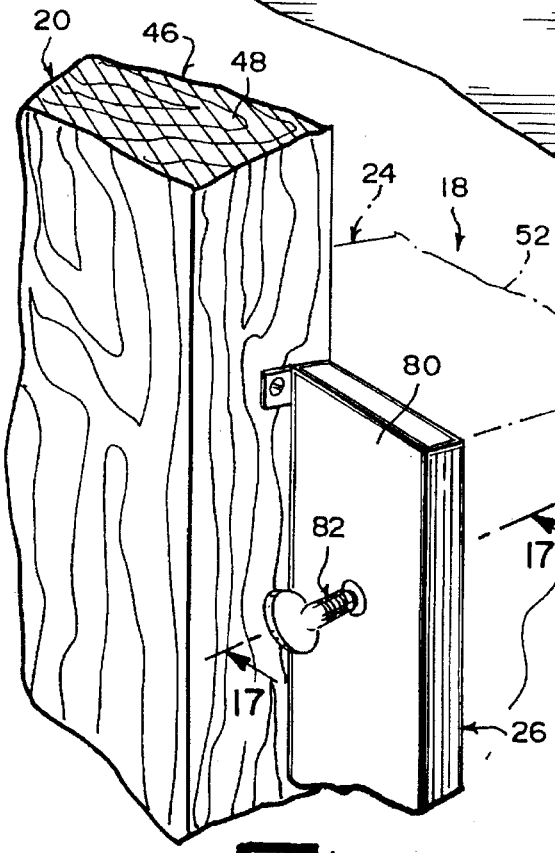

FIG. 16 is an enlarged perspective view as indicated by arrow 16 in FIG. 15.

Figure 17:
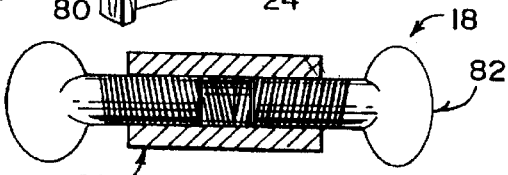

FIG. 17 is an enlarged cross sectional view taken along line 17—17 in FIG. 16, showing the structure of the retaining bolt assembly in greater detail.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 17 illustrate an improved storage bin system 18, comprising a plurality of spaced apart parallel pieces of timber 20 used in construction of a building 22. A plurality of storing receptacles 24 are provided. A structure 26 is for mounting each of the storing receptacles 24 between two of the adjacent pieces of timber 20. The storing receptacles 24 can hold articles 28 therein, instead of on a floor 30 in the building 22.

Figure 1:
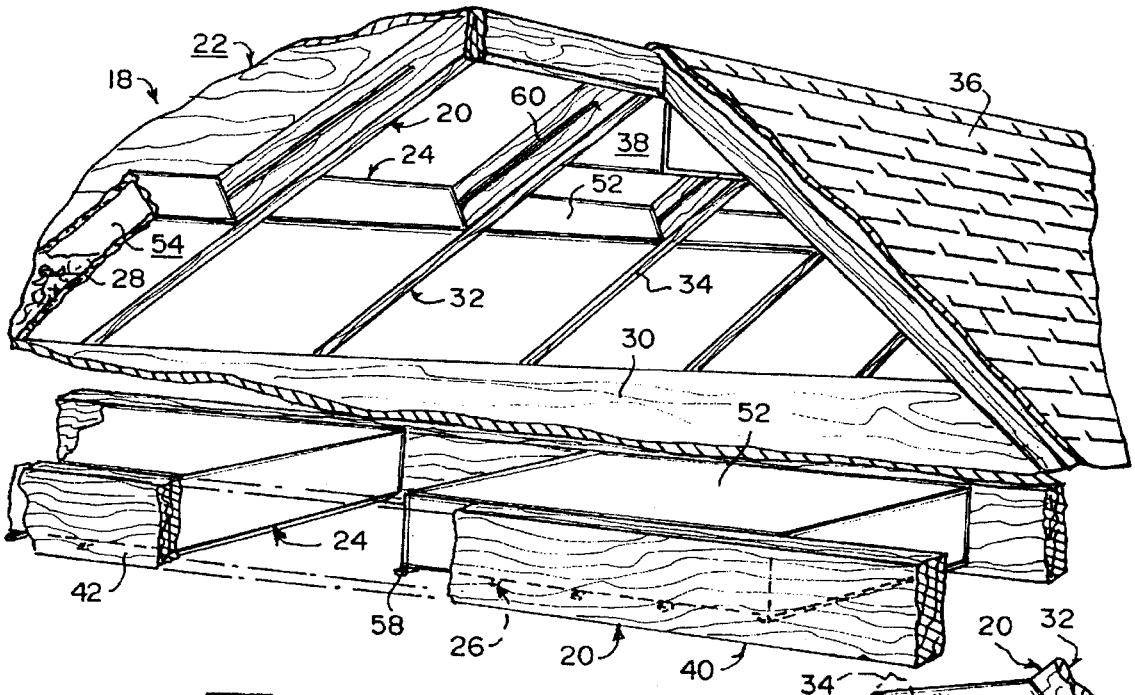
FIG. 1 is a perspective view of an upper portion of a building, showing the instant invention installed between the rafters and joists.
Figure 2:
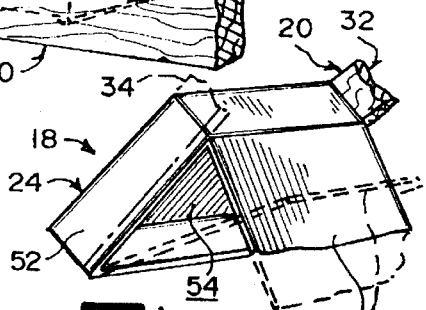
FIG. 2 is a perspective view showing one of the rafter storing receptacles, in which the movable cover can open from either side thereof.

Each piece of timber 20, shown in FIGS. 1, 2 and 4, is a rafter 32 that is a sloping beam 34 which supports a pitched roof 36 in an attic 38 of the building 22. Each piece of timber 20, shown in FIGS. 1, 3 and 13, is a joist 40 that is a horizontal beam 42 set from wall to wall, to support boards of the floor 30 and ceiling in the attic 38 in FIGS. 1 and 3, and a basement 44 in FIG. 13 of the building 22. Each piece of timber 20, shown in FIGS. 14, 15 and 16, is a stud 46 that is an upright post 48 in a framework of a wall in a garage 50 of the building 22.

Each storing receptacle 24 is a box-shaped container 52 having a compartment 54, to hold the articles 28 therein. The box-shaped container 52 includes at least one movable cover 56, to gain access into the compartment.

The mounting structure 26, shown in FIG. 1, consists of a plurality of fasteners 58, for maintaining each storing receptacle 24 in a stationary position between two of the adjacent pieces of timber 20. The mounting structure 26, best seen in FIG. 3, includes a plurality of tracks 60 and engaging wheels 62, for maintaining each storing receptacle 24 in an adjustable position between two of the adjacent pieces of timber 20.

Each storing receptacle 24 can be fabricated out of a fiberglass material 64, as shown in FIG. 8. Each storage receptacle 24, as shown in FIG. 7, can also be fabricated out of a light, resilient polystyrene plastic 66, with a reinforcement wire 68 therethrough.

Each storing receptacle 24 also contains a two line 70, shown in FIGS. 6, 7, 8 and 9. A component 72 in FIGS. 6 and 10, is for securing one end of the tow line 70 to one side of the storing receptacle 24. A person can pull the tow line 70, to move the storing receptacle 24 between the tracks 60 and engaging wheels 62. The securing component 72 is a staple 74. A needle 76, shown in FIG. 11, is for securing the end of the tow line 70 through the staple 74. A heater 78, shown in FIG. 12, is for attaching the staple 74 onto the one side of the storing receptacle 24.

The mounting structure 26 in FIGS. 15, 16 and 17, includes a pair of boards 80. Each board 80 is affixed vertically to an outer edge of one stud 48. A plurality of retaining bolt assemblies 82, extend through the boards 80 and into opposite sides of the storing receptacle 24, for maintaining the storing receptacle 24 between two of the adjacent studs 48.

OPERATION OF THE INVENTION

To use the improved storage bin system 18, the following steps should be taken:

1. Install each of the storing receptacles 24 in a stationary manner between two adjacent joists 40 by utilizing the fasteners 58, as shown in FIGS. 1 and 13.
2. Place each of the storing receptacles 24 firmly between two adjacent studs 48 by also utilizing the fasteners 58, as shown in FIG. 14.
3. Mount each of the storing receptacles 24 in an adjustable manner between two adjacent rafters 32 by utilizing tracks 60 and engaging wheels 62, as shown in FIGS. 1 and 3.
4. Secure the tow line 70 against one side of the storing receptacle 24 with the staple 74, as shown in FIGS. 6, 7 and 8, so that the storing receptacle 24 can be pulled along the tracks 60 by the engaging wheels 62 in FIGS. 1 and 3.
5. Fasten each storing receptacle 24 between two adjacent studs, by using the boards 80 and retaining bolt assemblies 82, as shown in FIGS. 15, 16 and 17.
6. Open each movable cover 56 to place the articles 28 into the respective compartments 54, so that storage is not needed on the floors 30.

LIST OF REFERENCE NUMBERS

18 storage bin system
20 piece of timber in 22
22 building
24 storing receptacle
26 mounting structure
28 article in 24
30 floor of 22
32 rafter for 20
34 sloping beam of 32
36 pitched roof
38 attic of 22
40 joist for 20
42 horizontal beam of 40
44 basement of 22
46 stud
48 upright post of 46
50 garage of 22
52 box-shaped container for 24
54 compartment in 52
56 movable cover of 52
58 fastener for 26
60 track of 26
62 engaging wheel of 26
64 fiberglass material of 24
66 light, resilient polystyrene plastic of 24
68 reinforcement wire in 66
70 tow line
72 securing component
74 staple for 72
76 needle
78 heater
80 board of 26
82 retaining bolt assembly It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved storage bin system comprising:

a) a plurality of spaced apart parallel pieces of timber used in construction of a building, each said piece of timber being: a rafter that is a sloping beam which supports a pitched roof in an attic of the building; a joist that is a horizontal beam set from wall to wall, to support boards of a floor and ceiling in an attic and a basement of the building; or a stud that is an upright post in a framework of a wall in a garage of the building;

b) a plurality of storing receptacles, each said storing receptacle being a box-shaped container having a compartment to hold articles therein, said box-shaped container including at least one movable cover to gain access into the compartment;

c) means for mounting each of said storing receptacles between two adjacent pieces of said timber, so that said storing receptacles can hold articles therein, instead of on a floor in the building, said mounting means including either i) a plurality of fasteners, maintaining each said storing receptacle in a stationary position between two of said adjacent pieces of timber, or ii) a plurality of tracks and engaging wheels maintaining each said storing receptacle in an adjustable position between two of said adjacent pieces of timber, each said storing receptacle being fabricated out of either a fiberglass material or a light, resilient polystyrene plastic with a reinforcement wire therethrough, each said storing receptacle including, when said mounting means includes a plurality of tracks and engaging wheels, a tow line, and means for securing one end of said tow line to one side of said storing receptacle, so that a person can pull said tow line to move said storing receptacle between said tracks and engaging wheels.

2. An improved storage bin system as recited in claim 1, wherein said securing means includes:

a) a staple;

b) a needle securing the end of said tow line through said staple; and c) a heater attaching said staple onto the one side of said storing receptacle.

3. An improved storage bin system comprising:

a) a plurality of spaced apart parallel pieces of timber used in construction of a building;

b) a plurality of storing receptacles, each said storing receptacle being a box-shaped container having a compartment to hold articles therein, said box-shaped container including at least one movable cover to gain access into the compartment;

c) means for mounting each of said storing receptacles between two adjacent pieces of said timber, so that said storing receptacles can hold articles therein, instead of on a floor in the building, said mounting means including a plurality of tracks and engaging wheels maintaining each said storing receptacle in an adjustable position between two of said adjacent pieces of timber, each said storing receptacle including a tow line and means for securing one end of said tow line to one side of said storing receptacle, so that a person can pull said tow line to move said storing receptacle between said tracks and engaging wheels.

4. An improved storage bin system as defined in claim 3, wherein said securing means includes:

a) a staple;

b) a needle securing the end of said tow line through said staple; and c) a heater attaching said staple onto the one side of said storing receptacle.

5. An improved storage bin system as recited in claim 1, wherein said mounting means includes:

a) a pair of boards, in which each said board is affixed vertically to an outer edge of one said stud; and b) a plurality of retaining bolt assemblies, extending through said boards and into opposite sides of said storing receptacle, maintaining said storing receptacle between two of said adjacent studs.

* * * * *